US006039436A

United States Patent [19]

Andrews et al.

[11] Patent Number: 6,039,436

[45] Date of Patent: Mar. 21, 2000

[54] THERMAL INK-JET PRINTHEAD WITH LATERAL THERMAL INSULATION FOR THE HEATING ELEMENTS

[75] Inventors: John R. Andrews, Fairport; Peter A. Torpey, Webster; Cathie J. Burke, Rochester; Eduardo M. Freire, Webster, all of N.Y.

[73] Assignee: Xerox Corporation, Stamford, Conn.

[21] Appl. No.: 09/041,305

[22] Filed: Mar. 12, 1998

[51] Int. Cl.[7] ..... B41J 2/05

[52] U.S. Cl. ..... 347/62; 347/64

[58] Field of Search ..... 347/64, 62

[56] References Cited

U.S. PATENT DOCUMENTS

| | | | |
|---|---|---|---|
| 4,860,033 | 8/1989 | Shiozaki et al. | 347/64 |
| 4,899,181 | 2/1990 | Hawkins et al. | 156/647 X |
| 4,951,063 | 8/1990 | Hawkins et al. | 347/64 |
| 5,010,355 | 4/1991 | Hawkins et al. | 347/64 |
| 5,257,042 | 10/1993 | Buhler | 347/64 |
| 5,576,748 | 11/1996 | Tamura | 347/64 X |
| 5,639,386 | 6/1997 | Burke et al. | 216/27 |
| 5,729,261 | 3/1998 | Burke et al. | 347/64 |
| 5,849,809 | 12/1998 | Narang et al. | 522/35 |

*Primary Examiner*—Matthew S. Smith
*Attorney, Agent, or Firm*—R. Hutter

[57] ABSTRACT

In an ejector for a thermal ink-jet printhead, a heating element exposing an area to liquid ink in the printhead includes an insulative layer around the lateral edges thereof, particularly those edges not having conductors associated therewith. This insulation creates a more uniform temperature distribution over the heating area, resulting in a uniform nucleation of a vapor bubble within the liquid ink.

8 Claims, 3 Drawing Sheets

THERMAL INK-JET PRINTHEAD WITH LATERAL THERMAL INSULATION FOR THE HEATING ELEMENTS

FIELD OF THE INVENTION

The present invention relates to a printhead for a thermal ink-jet printer, in which the heating element of each ejector is surrounded along its perimeter by a layer of thermal insulation.

BACKGROUND OF THE INVENTION

In thermal ink-jet printing, droplets of ink are selectably ejected from a plurality of drop ejectors in a printhead. The ejectors are operated in accordance with digital instructions to create a desired image on a print sheet moving past the printhead. The printhead may move back and forth relative to the sheet in a typewriter fashion, or the linear array may be of a size extending across the entire width of a sheet, to place the image on a sheet in a single pass.

The ejectors typically comprise capillary channels, or other ink passageways, which are connected to one or more common ink supply manifolds. Ink is retained within each channel until, in response to an appropriate digital signal, the ink in the channel is rapidly heated by a heating element disposed on a surface within the channel. This rapid vaporization of the ink adjacent the channel creates a bubble which causes a quantity of liquid ink to be ejected through an opening associated with the channel to the print sheet. The process of rapid vaporization creating a bubble is generally known as "nucleation." One patent showing the general configuration of a typical ink-jet printhead is U.S. Pat. No. 4,774,530, assigned to the assignee in the present application.

In order to create nucleation of a vapor bubble in a quantity of liquid ink, the liquid ink in a specific small area adjacent to the heating element must be brought to a sufficiently high temperature. Although a heating element exposed to the liquid may be provided with a generally sufficient "burn voltage," not all of the area of the heating element exposed to the liquid ink will be of a sufficiently high temperature to create nucleation. It has been found that the central portion of the effective area of a heating element reaches a sufficiently high burn voltage well before areas around the periphery of the heating element area. That is, the heating element may have a sufficiently high temperature only in a relatively small central area thereof, while the outer-lying portions of the heating element area will not be of a sufficient high temperature, and therefore nucleation will occur only for the liquid ink disposed toward the center of the heating element area. This phenomenon causes any number of practical drawbacks, such as: unpredictability of the volume of a resulting ejected droplet; a wasting of energy when a significant portion of the heating element is continually brought close to, but not over, the sufficient temperature; and an undesirable accumulation of excess heat within the printhead.

The phenomenon of the center of a heating element area consistently being hotter than the outer portions of the heating element area can in large part be traced to a lateral leakage of heat energy from the heating element area to other areas within the printhead. By "lateral" is meant that a significant component of heat energy is lost along the edges of the perimeter formed by the area of the heating element exposed to the liquid ink. In the case of a "side shooter" design of a printhead, where the heating elements are typically formed on a main surface of a silicon chip, this lateral heat leakage can be significant.

DESCRIPTION OF THE PRIOR ART

In the prior art, U.S. Pat. No. 5,639,386, assigned to the same assignee as the present invention, and having one common co-inventor with the present invention, describes a configuration of a heating element in an ink-jet printhead ejector, in which layers of phosphosilicate glass are arranged next to a layer of doped polysilicon forming a heating element. However, the disclosure is directed only to those edges of the heating element having electrical conductors to the heating element. The heating element is not uniformly doped between the two electrical contacts.

SUMMARY OF THE INVENTION

According to the present invention, there is provided a thermal ink-jet printhead comprising at least one ejector. The ejector comprises a structure defining a channel for passage of liquid ink therethrough. A heating element defines a substantially rectangular heating element area within the channel, the heating element area defining at least a first lateral edge and a second lateral edge, the first lateral edge and second lateral edge not having an electrode associated therewith. The heating element includes a layer of polysilicon defining a thickness, the polysilicon being uniformly doped from the first lateral edge to the second lateral edge. An insulator is disposed along the first lateral edge and the second lateral edge, the insulator defining a thickness not less than the thickness of the heating element at the perimeter of the heating element area. A portion of the insulator extends over a portion of the heating element.

DETAILED DESCRIPTION OF THE INVENTION

Figure 1:
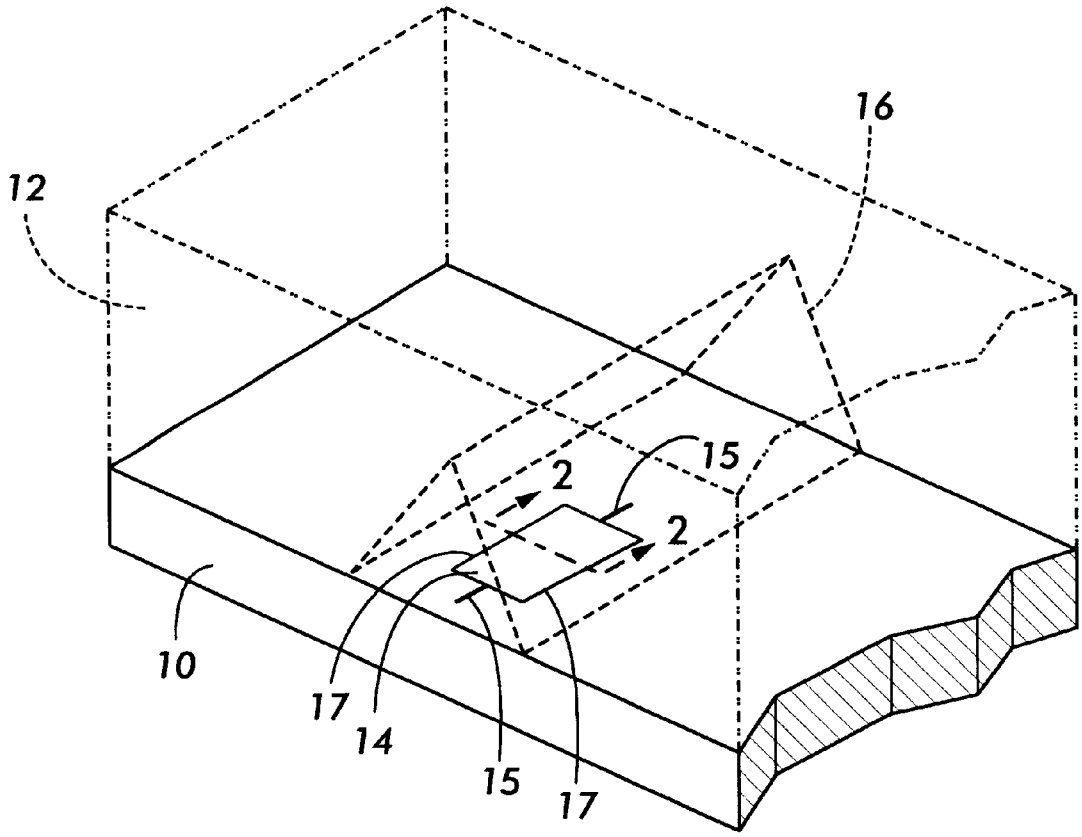
FIG. 1 PRIOR ART
FIG. 1 is a simplified perspective view showing the basic elements of a heater chip and channel chip in a single ejector of a thermal ink-jet printhead suitable for use in the present invention.

FIG. 1 is a highly simplified perspective view showing the portions of an ejector for a thermal ink-jet printhead incorporating the present invention. Although only one ejector is shown, it will be understood that a practical thermal ink-jet printhead will include 40 or more such ejectors, typically spaced at 300 to 600 ejectors per inch. Illustrated in FIG. 1 is the general configuration of what is known as a "side-shooter" printhead wherein the channels forming the ejectors are created between two chips which are bound together. The printhead comprises a heater chip 10, which is bound on a main surface thereof to a "channel chip" indicated in phantom as 12. The heater chip 10 is generally a semiconductor chip design as known in the art, and defines therein any number of heating elements, such as generally indicated as 14, on a main surface thereof. There is typically provided one heating element 14 for every ejector in the printhead. Adjacent each ejector 14 on the main surface of heater chip 10 is a channel 16 which is formed by a groove in channel chip 12. Channel chip 12 can be made of any number of ceramic, plastic, or metal materials known in the art. When the chip 10 is abutted against the channel chip 12, each channel 16 forms a complete channel with the adjacent surface of the heater chip 10, and one heating element 14 disposes a heating surface on the inside of the channel so formed, as shown in FIG. 1.

In operation, an ink supply manifold (not shown) provides liquid ink which fills the capillary channel 16 until it is time to eject ink from the channel 16 onto a print sheet. In order to eject a droplet of ink from channel 16, a small voltage is applied to heating element 14 in heater chip 10. As is familiar in the art of ink-jet printheads, heating element 14 is typically a portion of a semiconductor chip which is doped to a predetermined resistivity. Because heating element 14 is essentially a resistor, heating element 14 dissipates power in the form of heat, thereby vaporizing liquid ink immediately adjacent the heating surface. This vaporization creates a bubble of ink vapor within the channel, and the expansion of this bubble in turn causes liquid ink to be expelled out of the channel 16 and onto a print sheet to form a spot in a desired image being printed. As shown in the view of FIG. 1, it is intended that the ink supply manifold be disposed behind the printhead, so that the ejected ink droplet will be ejected out of the page according to the perspective of FIG. 1.

FIG. 1 shows a highly simplified version of a practical thermal ink-jet printhead, and any number of ink supply manifolds, intermediate layers, pit layers, etc., which are not shown, would be provided in a practical printhead. However, it is apparent from FIG. 1 that the heating element area formed by heating element 14 effectively exposed within channel 16 is substantially rectangular, and two of the four edges of the heating element area are associated with conductors, indicated as 15, which are used to supply energy to the heating element 14. Further, these conductors 15 are disposed in effect parallel to the direction of ink movement through channel 16. In the present description, the edges of heating element 14 which are not associated with conductors 15 are called first and second "lateral" edges and indicated as 17. The heating element 14 is preferably polysilicon which is uniformly doped from a first lateral edge 17 to the second lateral edge 17, all the more to achieve a uniformity of resulting heat generation across the heating element 14.

As mentioned above, in any kind of thermal ink-jet printhead, a leakage of heat energy through the lateral edges 17 of heating element 14 along the main surface of chip 10 can cause the undesirable effect of the center portion of a heating element 14 reaching a higher temperature than the periphery of the area of heating element 14 exposed to the liquid ink in the channel. In a preferred embodiment of the present invention, the lateral edges 17 of a heating element 14 are at least twice as long as the edges of the heating element 14 associated with conductors 15; in one practical embodiment of the present invention, the heating element 14 has plan dimensions of 20 micrometers by 195 micrometers. Thus, these lateral edges 17 are the site of possible major leakage of heat. In order to restrict the flow of heat through the long lateral edges 17 of heating element 14, the present invention proposes an insulator disposed adjacent the lateral edges 17 of heating element 14 within channel 16.

Figure 2:
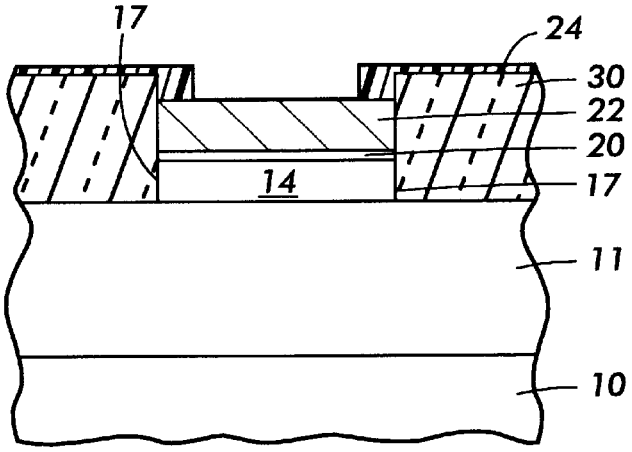
FIG. 2 is a cross-sectional view through lines 2—2 in FIG. 1 showing the structure of one type of thermally-insulated heating element according to the present invention.

FIG. 2 is a cross-sectional view, through line 2—2 in FIG. 1, showing one possible embodiment of a laterally-insulated heating element according to the present invention. Here, the heating element 14, which is typically made of polysilicon which has been doped to a predetermined resistance, is disposed on a layer of thermal insulation 11, which is typically a layer of silcon dioxide disposed over the main surface of heater chip 10. The polysilicon of heating element 14 defines a particular thickness, typically of about 0.4 micrometers, in a dimension perpendicular to the heating element area. Disposed immediately over the heating element 14 is an electrical insulating layer 20, which is typically made of a thin layer of silicon nitride. Above the protection layer 20 is disposed a heater passivation layer 22 typically made of tantalum, which protects the heating element 14 from corrosion caused by liquid ink in the channel. The silicon nitride layer is of a typical thickness of 0.1 micrometers, and the heater passivation layer 22 is of a typical thickness of 0.5 micrometers. The thermal insulation layer 11 is of a typical thickness of about 1.5 micrometers.

Disposed next to the heating element 14 in the view of FIG. 2 is a layer of phosphosilicate glass (PSG), indicated as 30, which surrounds the perimeter of heating element 14, in particular along each lateral edge 17. It will be apparent that such a structure will restrict the flow of heat from heating element 14 through lateral edge 17 along the top surface of chip 10. Preferably, the thickness of the insulator 30 should be at least equal to, and preferably slightly more than, the thickness of the heating element 14. An overall protective layer of polyimide indicated as 24, covers the insulator 30 and a portion of the heater passivation layer 22, as shown. It will be noted that, in a preferred embodiment of the invention, the polyimide layer 24 extends over the perimeter of the heating element 14.

In general, the thermal insulators in a printhead according to the present invention should have low thermal conductivity and low heat capacity. Organic polymer layers such as polyimide or other photopatternable polymers are especially convenient in providing thermal insulation at the edges of the heating element 14 and protecting the edges form chemical invasion. PSG also provides good thermal insulation and protection of the heating element edges. Although the illustrated embodiments show the use of both PSG and polyimide, it is possible to have a printhead using only one of these materials as an insulative layer.

Figure 3:
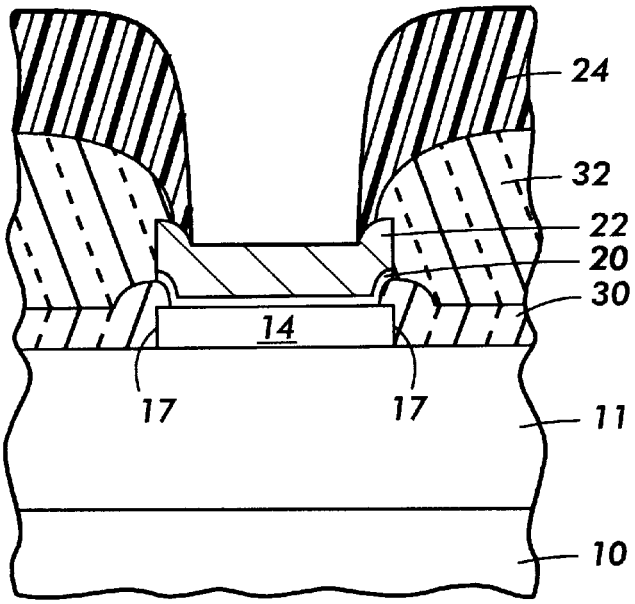
FIG. 3 is a cross sectional view similar to that shown in FIG. 2, showing a preferred embodiment of a thermally-insulated heating element according to the present invention.

FIG. 3 is a cross-sectional view, similar to the cross-sectional view shown in FIG. 2, showing a preferred embodiment of the laterally-insulated heating element of the claimed invention. In FIGS. 2 and 3, like reference numerals indicate analogous elements. The configuration of this specific embodiment is motivated by the fact that, while tantalum is a useful material for a passivation layer to protect the heating element 14, it is fairly highly thermally conductive. For this reason, the insulator 30 is configured to have a portion which extends over a portion of the heating element 14. In turn, the heater passivation layer 22 includes portions around the periphery thereof which extend over the portion of the insulator 30 which extend over the edges of the heating element 14, as shown. The area of heating element 14 placed under the insulator 30 serves to increase the temperature of heating element 14, partially compensating for residual lateral heat loss. An electrically insulating layer 20 is disposed between the heating element 14 and the heater passivation layer 22, and a preferred material for this layer is silicon nitride.

There is also provided, in the FIG. 3 embodiment, a circuitry passivation layer 32, which is disposed generally over the insulator 30. To some extent this circuitry passivation layer 32, which is also made of PSG, can be used as a heat sink for excess heat accumulated in the heater passivation layer 22. According to one preferred embodiment, the PSG in layer 30 is about 7.5% by weight phosphorus, and the PSG in layer 32 is about 4% by weight phosphorus; in general, phosphorus improves the flowability of the PSG, but too high a proportion of phosphorus may react with aluminum conductors in the chip. As in the FIG. 2 embodiment, the structure around the heating element area is preferably coated with a thin protective layer of polyimide 24, which extends over the perimeter of the heating element 14. Also as in the FIG. 2 embodiment, a typical thickness of the heating element 14 is about 0.4 micrometers; a typical thickness of the insulative layer 20 is 0.1 micrometers, and a typical thickness of the heater passivation layer 22 is 0.5 micrometers.

Figure 4:
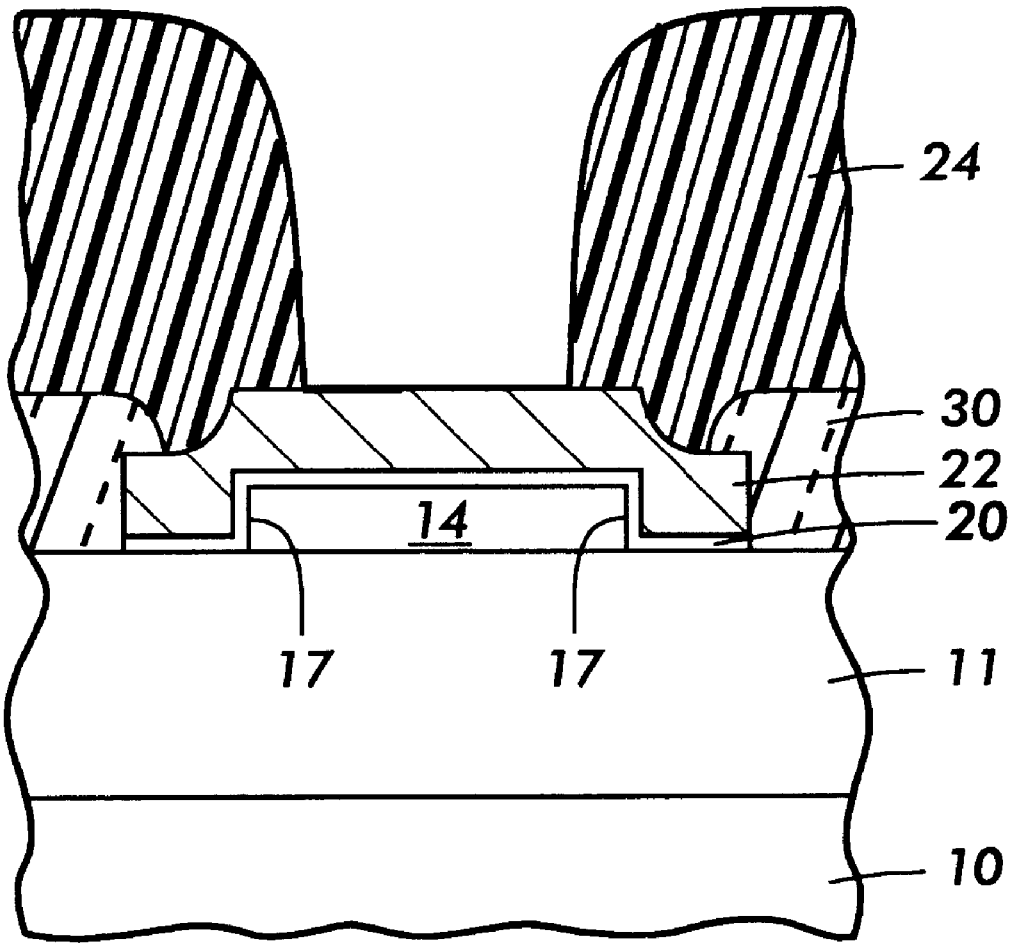
FIG. 4 is a cross sectional view similar to that shown in FIG. 2, showing another possible embodiment of a thermally-insulated heating element according to the present invention.

FIG. 4 is another cross-sectional view, similar to that of FIG. 2, showing yet another embodiment of the present invention. In FIG. 4, like-numbered elements correspond to analogous elements in FIGS. 2 or 3. In this embodiment, the heater passivation layer 22 extends beyond the perimeter of heating element 14, and is effectively disposed between the edge of heating element 14 and insulator 30.

While the invention has been described with reference to the structure disclosed, it is not confined to the details set forth, but is intended to cover such modifications or changes as may come within the scope of the following claims.

We claim:

1. A thermal ink-jet printhead comprising at least one ejector, the ejector comprising:

a structure defining a channel for passage of liquid ink therethrough;

a heating element, defining a substantially rectangular heating element area within the channel, the heating element area defining at least a first lateral edge and a second lateral edge, the first lateral edge and second lateral edge not having an electrode associated therewith, the heating element including a layer of polysilicon defining a thickness, the polysilicon being uniformly doped from the first lateral edge to the second lateral edge; and a first insulator disposed along the first lateral edge and the second lateral edge, the insulator defining a thickness not less than the thickness of the heating element at the perimeter of the heating element area, a portion of the first insulator extending over a portion of the heating element.

2. The printhead of claim 1, the first insulator comprising phosphosilicate glass.

3. The printhead of claim 1, the first insulator comprising an organic polymer.

4. The printhead of claim 1, further comprising a passivation layer disposed over the heating element area, a portion of the passivation layer extending over the first insulator.

5. The printhead of claim 1, further comprising a second insulator, extending over at least a portion of the first insulator.

6. The printhead of claim 5, the first insulator comprising phosphosilicate glass having a first proportion of phosphorus, the second insulator comprising phosphosilicate glass having a second proportion of phosphorus different from the first proportion of phosphorus.

7. The printhead of claim 1, further comprising a passivation layer disposed over the heating element area, a portion of the passivation layer extending over the portion of the first insulator extending over a portion of the heating element.

8. The printhead of claim 7, further comprising a second insulator, extending over at least a portion of the first insulator and extending over at least a portion of the passivation layer.

* * * * *